United States Patent [19]

Staebler

[11] 3,982,860

[45] Sept. 28, 1976

[54] THRUST BEARINGS FOR SLANT AXIS ROTARY MECHANISMS

[75] Inventor: Paul J. Staebler, Dunlap, Ill.

[73] Assignee: Caterpillar Tractor Co., Peoria, Ill.

[22] Filed: Dec. 8, 1975

[21] Appl. No.: 638,779

[52] U.S. Cl. ..... 418/53

[51] Int. Cl.[2] ..... F01C 1/02

[58] Field of Search ..... 418/49, 50, 51, 52, 418/53, 68

[56] References Cited

UNITED STATES PATENTS

| | | | |
|---|---|---|---|
| 410,308 | 9/1889 | Bowns | 418/53 |
| 3,193,187 | 7/1965 | Jones et al. | 418/60 |
| 3,485,218 | 12/1969 | Clarke | 418/53 |

*Primary Examiner*—C. J. Husar
*Assistant Examiner*—Leonard E. Smith
*Attorney, Agent, or Firm*—Wegner, Stellman, McCord, Wiles & Wood

[57] ABSTRACT

An improved slant axis rotary mechanism such as an engine, compressor, pump, or the like. The same includes a housing defining an operating chamber with a shaft journalled in the housing and including an angularly offset portion within the chamber. The angularly offset portion includes a generally radially extending shoulder and a unitary rotor is journalled on the angularly offset portion within the chamber. The rotor includes a central bore receiving the angularly offset portion and the bore further includes a generally radially inwardly opening groove. A plurality of thrust collar segments are disposed in the groove and extend partially out of the same into embracing relationship with the shoulder. A positioning collar is located on the shaft to sandwich the segments against the shoulder. The positioning collar defines a continuation of the angularly offset portion and journals the rotor. Means are provided for holding the positioning collar against axial and rotational movement on the shaft.

6 Claims, 4 Drawing Figures

THRUST BEARINGS FOR SLANT AXIS ROTARY MECHANISMS

BACKGROUND OF THE INVENTION

This invention relates to rotary mechanisms and, more specifically, to slant axis rotary mechanisms for use as engines, compressors, pumps, or the like.

Slant axis rotary mechanisms include an angularly offset portion in their shaft disposed within an operating chamber. A rotor is conventionally journalled on the angularly offset portion as is well known.

In order to assemble the rotor on the shaft, it is necessary to either split the shaft or the rotor. When the shaft is split, the same is seriously weakened thereby diminishing the capacity of the mechanism.

Heretofore, when the second approach is taken, namely, the splitting of the rotor, the rotor has been left largely in one piece with the split being made at a relatively small diameter. In effect, the rotor is held assembled to the shaft by a large diameter nut. This approach is not altogether satisfactory in that large loads are imposed on the point of connection, normally threads, which loads are cyclic in nature and therefore conducive to fatigue failure.

SUMMARY OF THE INVENTION

It is the principal object of the invention to provide a new and improved rotary mechanism. More specifically, it is an object of the invention to provide such a mechanism wherein ease of assembly of a rotor to a shaft is maximized while avoiding splitting of the shaft or the use of threaded connections subject to high cyclic loading and fatigue failure.

The exemplary embodiment of the invention achieves the foregoing object in a slant axis rotary mechanism including a housing defining an operating chamber. A shaft is journalled in the housing and includes an angularly offset portion within the chamber. The angularly offset portion includes a generally radially extending shoulder. A unitary rotor is journalled on the angularly offset portion and within the chamber. The rotor includes a central bore receiving the angularly offset portion, which bore includes a radially inwardly opening groove. A plurality of thrust collar segments are disposed in the groove and extend partially out of the same to embrace the shoulder. A positioning collar is disposed on the shaft to sandwich the segments against the shoulder and the positioning collar preferably defines a continuation of the angularly offset portion to thereby assist in journalling the rotor. Means are provided for holding the positioning collar against the axial and rotational movement on the shaft.

According to a highly preferred embodiment, keying means are employed to interconnect the segments and the shoulder. According to one embodiment, the keying means may comprise a circumferential step on the shoulder, while according to another embodiment, the keying means may comprise pins.

According to a highly preferred embodiment of the invention, the angularly offset portion comprises a further positioning collar mounted on the shaft and means are provided for fixing the further positioning collar against rotary and axial movement on the shaft. According to the best mode contemplated, a common splined surface is disposed on the shaft for engagement with mating splined surfaces on both the positioning collars.

Other objects and advantages will become apparent from the following specification taken in connection with the accompanying drawings.

DESCRIPTION OF THE PREFERRED EMBODIMENTS

Figure 1:
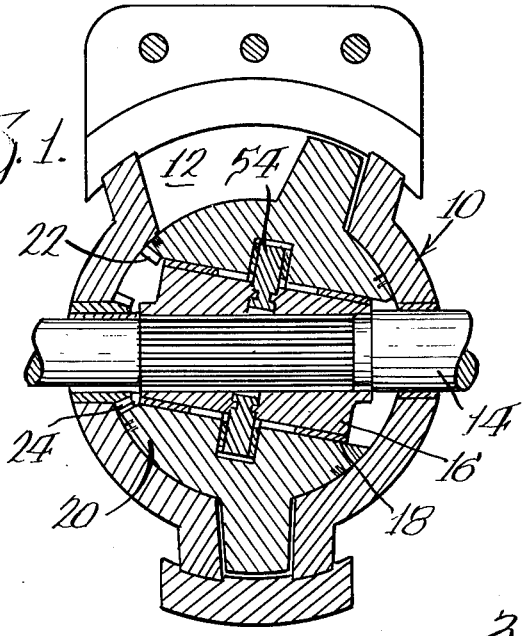
FIG. 1 is a sectional view of a slant axis rotary mechanism made according to the invention.

An exemplary embodiment of a slant axis rotary mechanism made according to the invention is illustrated in FIG. 1 in the form of a four-cycle slant axis rotary engine. However, it is to be understood that the invention is applicable to two-cycle mechanisms as well, pumps, and compressors, or the like.

The mechanism includes a housing, generally designated 10, which in turn defines an operating chamber 12. A shaft 14 is journalled in the housing 10 and includes an angularly offset portion 16. Suitable bearings 18 on the angularly offset portion 16 journal a rotor 20. The rotor 20 carries suitable seals (not shown) for sealing engagement with the various walls of the chamber 12 in a manner well known. In addition, the rotor 20 is provided with an internal ring gear 22 in engagement with a fixed gear 24 whereby the proper timed relative movement between the shaft 14 and the rotor 20 is obtained.

Figure 2:
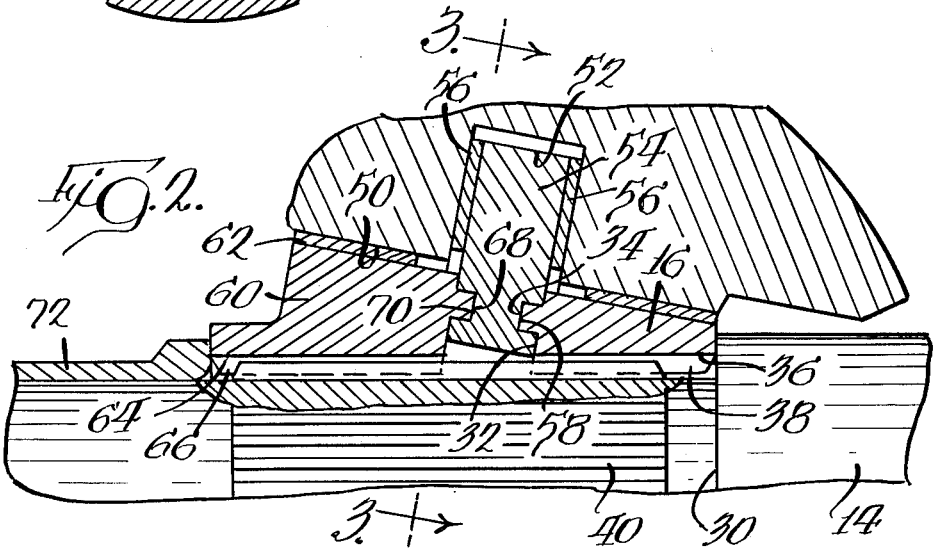
FIG. 2 is an enlarged, fragmentary, sectional view of the interface of the rotor of the mechanism and the shaft of the mechanism.

Turning now to FIG. 2, the angularly offset portion 16 is defined by a positioning collar abutted against a shoulder 30 on the shaft 14. The opposite side of the positioning collar 16 includes a shoulder 32 provided with a circumferential step 34 for purposes to be seen.

In addition, the positioning collar defining the angularly offset portion 16 includes an internal bore 36 provided with splines 38 in meshing engagement with splines 40 carried by the shaft 14.

The rotor 20 includes an internal central bore 50 having a radially inwardly opening groove 52. The groove 52 receives a plurality of thrust collar segments 54 along with suitable thrust bearings 56. Each thrust collar segment 54 extends out of the groove 52 sufficiently so as to engage the shoulder 32 of the positioning collar defining the angularly offset portion 16. According to the embodiment illustrated in FIG. 2, that portion of each thrust bearing segment 54 extending out of the groove is also provided with a recess 58 for disposition on the step 34 to provide a keying action.

A positioning collar 60 is disposed on the shaft 14 in such a way as to sandwich the thrust collar segments 54 against the positioning collar defining the angularly offset portion 16. In addition, the positioning collar 60 is configured to define a continuation of the angularly offset portion 16 to thereby assist in journalling the rotor 20 by means of bearings 62.

The positioning collar 60 includes an internal bore 64 provided with a splined surface 66 for mating splined engagement with the splines 40 on the shaft 14 as well as a step 68 for disposition in a recess 70 in the side of the thrust collar segment 54 opposite from the recess 58, again for keying purposes. A sleeve 72 may be firmly affixed to the shaft 14 by any suitable means to abut the positioning collar 60 to maintain the elements in the assembled relation illustrated in FIG. 2.

Figure 4:
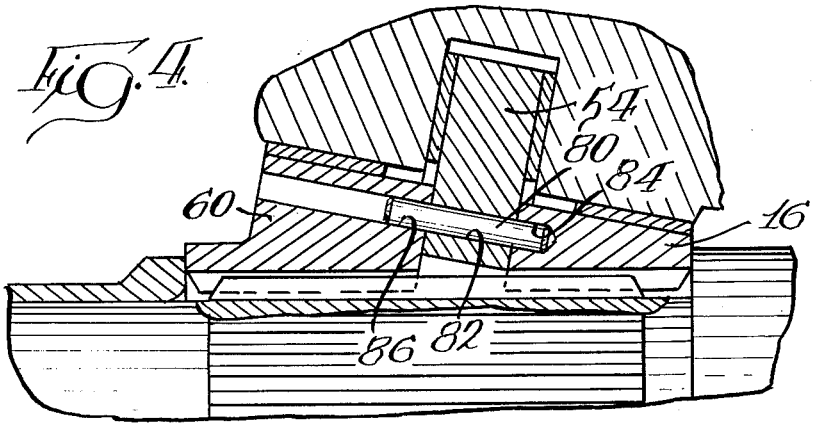
FIG. 4 is an enlarged, fragmentary, sectional view along the lines of that illustrated in FIG. 2 but of a modified embodiment of the invention.

A modified embodiment of the invention is illustrated in FIG. 4. In lieu of the use of the steps 34 and 68 and grooves 58 and 70 as keying means for keying the thrust collar segments 54 to the positioning collars 16 and 60, pins 80 extending through suitable bores 82 in each segment 54 and into aligned bores 84 and 86 in the positioning collars 16 and 60 respectively, are employed. In all other respects, the embodiment illustrated in FIG. 4 is identical to that heretofore described.

Figure 3:
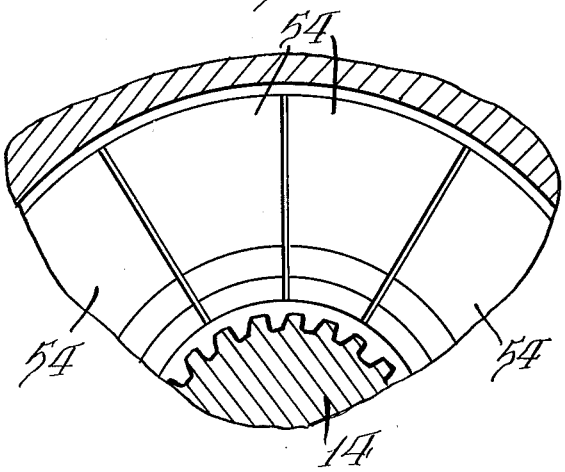
FIG. 3 is a fragmentary, sectional view taken along the line 3—3 of FIG. 2.

The thrust collar segments 54 will generally be in the shape illustrated in FIG. 3, although it is to be understood that FIG. 3 is not a scale drawing. It is necessary that the segments be as short in the circumferential direction as is necessary to allow the same to be inserted into the groove 52. Similarly, the spacing between the adjacent segments 54 must be such that the last one of the segments to be inserted into the groove has a maximum, circumferential length no greater than the total circumference minus the circumferential sum of the already installed segments. Alternately, and preferably, the last segment to be installed is provided with parallel sides for ease of installation.

From the foregoing, it will be appreciated that a slant axis rotary mechanism made according to the invention achieves the objects of enabling ease of installation while eliminating the need for split shafts or threaded connections in the rotor itself which are prone to failure due to cyclic loading. The construction enables the use of a unitary rotor (one piece, not considering the provision of seals or bearings, etc.) as well as a one-piece shaft.

What is claimed is:

1. In a slant axis rotary mechanism, the combination comprising:

a housing defining an operating chamber;

a shaft journalled in said housing and including an angularly offset portion within said chamber, said angularly offset portion including a generally radially extending shoulder;

a unitary rotor journalled on said angularly offset portion and within said chamber, said rotor including a central bore receiving said angularly offset portion, said bore including a radially inwardly opening groove;

a plurality of thrust collar segments in said groove and extending partially out of the same into embracing relation with said shoulder;

a positioning collar on said shaft sandwiching said segments against said shoulder, said positioning collar defining a continuation of said angularly offset portion and journalling said rotor; and means holding said positioning collar against axial and rotational movement on said shaft.

2. The slant axis rotary mechanism of claim 1 further including keying means interconnecting said segments and said shoulder.

3. The slant axis rotary mechanism of claim 2 wherein said keying means comprise a circumferential step on said shoulder.

4. The slant axis rotary mechanism of claim 2 wherein said keying means comprise pins.

5. The slant axis rotary mechanism of claim 1 wherein said angularly offset portion comprises a further positioning collar mounted on said shaft, and means fixing said further positioning collar against rotary and axial movement on said shaft.

6. The slant axis rotary mechanism of claim 5 wherein said holding means and said fixing means comprise a common splined surface on said shaft in engagement with mating splined surfaces on said positioning collars.

* * * * *